United States Patent [19]

Templeton

[11] Patent Number: 5,033,142

[45] Date of Patent: Jul. 23, 1991

[54] DIVING TOOL KIT

[76] Inventor: Larry W. Templeton, P.O. Box 839, Albany, Ga. 31702

[21] Appl. No.: 555,185

[22] Filed: Jul. 2, 1990

[51] Int. Cl.[5] ..... B25G 1/08

[52] U.S. Cl. ..... 7/167; 7/116; 224/222

[58] Field of Search ..... 7/106, 114, 116, 167; 294/51; 224/222

[56] References Cited

U.S. PATENT DOCUMENTS

| | | | |
|---|---|---|---|
| 810,987 | 1/1906 | Spicer | 7/167 |
| 1,567,908 | 12/1925 | Brigham | 7/116 X |
| 3,473,712 | 10/1969 | Genchi | 7/116 X |
| 4,631,770 | 12/1986 | Goldberg | 7/167 |

*Primary Examiner*—James G. Smith
*Attorney, Agent, or Firm*—Leon Gilden

[57] ABSTRACT

An apparatus is set forth for use by undersea divers and the like wherein an elongate, hollow handled tool comprises a rear cap mounted to the tube with a flexible polymeric handle directed through the cap. A forward end of the tool includes a threaded enclosure member containing a threaded aperture for mountingly receiving a threaded boss of one of a series of implements selectively securable to the tool for various use under water, such as a spike, a chisel, a shovel, and a rake. A pouch member is utilized for securement of the tools and worn by an individual during use of the organization. Optionally, a replaceable chemical glow tube may be positioned interiorly of the tube, wherein the tube may be formed of a translucent material to enable visual orientation of the tube under water. Furthermore, a grip member may be selectively securably by use of hook and loop fastener strips about the tube or optionally, the grip member may be moulded to the tube.

5 Claims, 4 Drawing Sheets

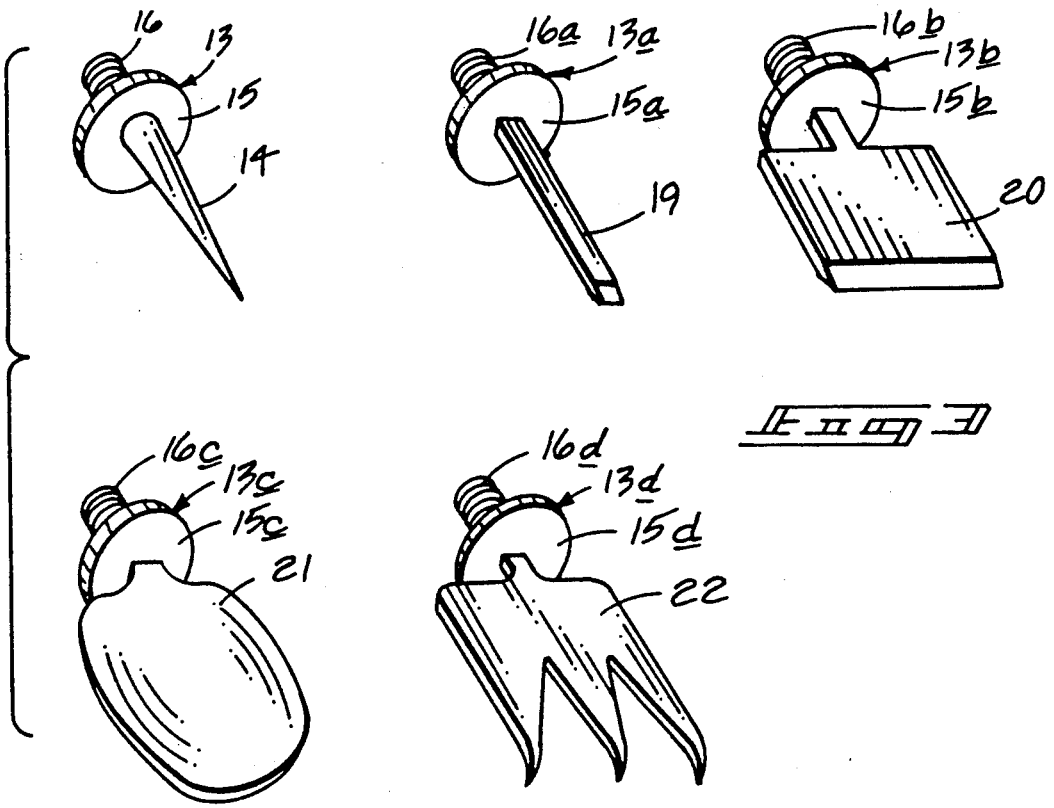
Fig 3
Fig 4
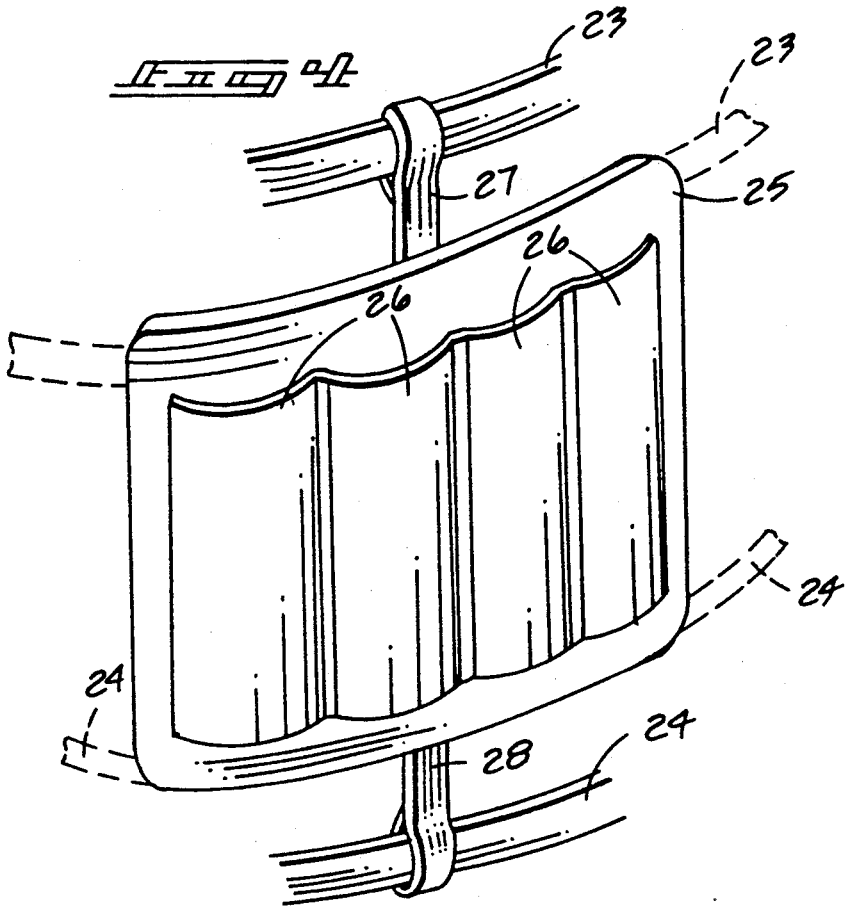

DIVING TOOL KIT

BACKGROUND OF THE INVENTION

1. Field to the Invention

The field of invention relates to undersea water tools, and more particularly pertains to a new and improved diving tool kit wherein the same provides for an elongate tool with selectable heads optionally mounted to a forward end of the tube.

2. Description of the Prior Art

Diving tools of various configurations are utilized in the prior art. Heretofore, however, the tools have been of a unique and particular configuration, such as the use of a shovel or a pick, taken under water by an individual. Unfortunately, tools of the prior art have frequently been formed of metallic materials for particular use in situations remote from a water environment. The instant invention attempts to overcome deficiencies of the prior art by providing a tool formed with selectively mountable heads to enable an individual a tool array for use in an underwater scenario. Examples of the prior art include U.S. Pat. No. 2,087,148 to Hempy illustrative of a pry bar formed with a chisel end.

U.S. Pat. No. 2,300,840 to Huxel sets forth a utility bar formed with a bifurcated pry bar at one end and a pointed end mounted thereon.

U.S. Pat. No. 4,112,530 to Lecce is illustrative of a tool formed with a hammer, a claw member, and a handle mounted to the shaft supporting the tools.

U.S. Pat. No. 3,710,470 to Reid is illustrative of a tool utilizing a plurality of various members, such as a pry bar, cutting means, spike means, and the like mounted to the tool.

U.S. No. 4,597,123 to Cobe is illustrative of another combination tool including a further array of members integrally mounted to the tool, such as a spanner wrench, a hammer, a chisel, and the like.

As such, it may be appreciated that there is a continuing need for a new and improved diving tool kit wherein the same addresses both the problems of tool selection and convenience of use in an underwater environment, and in this respect, the present invention substantially fulfills this need.

SUMMARY OF THE INVENTION

In view of the foregoing disadvantages inherent in the known types of tool combinations now present in the prior art, the present invention provides a diving tool kit wherein the same provides an asemblage of components for selective use in an underwater environment. As such, the general purpose of the present invention, which will be described subsequently in greater detail, is to provide a new and improved diving tool kit which has all the advantages of the prior art tool combinations and none of the disadvantages.

To attain this, the present invention includes an apparatus for use by undersea divers and the like wherein an elongate, hollow handled tool comprises a rear cap mounted to the tube with a flexible polymeric handle directed through the cap. A forward end of the tool includes a threaded enclosure member containing a threaded aperture for mountingly receiving a threaded boss of one of a series of implements selectively securable to the tool for various use under water, such as a spike, a chisel, a shovel, and a rake. A pouch member is utilized for securement of the tools and worn by an individual during use of the organization. Optionally, a replaceable chemical glow tube may be positioned interiorly of the tube, wherein the tube may be formed of a translucent material to enable visual orientation of the tube under water. Furthermore, a grip member may be selectively securable by use of hook and loop fastener strips about the tube or optionally, the grip member may be molded to the tube.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other strutures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved diving tool kit which has all the advantages of the prior art tool combinations and none of the disadvantages.

It is another object of the present invention to provide a new and improved diving tool kit which may be easily and efficiently manufactured and marketed.

It is a further object of the present invention to provide a new and improved diving tool kit which is of a durable and reliable construction.

An even further object of the present invention is to provide a new and improved diving tool kit which is susceptible of a low cost of manufacture with regard to both materials and labor, and which accordingly is then susceptible of low prices of sale to the consuming public, thereby making such diving tool kits economically available to the buying public.

Still yet another object of the present invention is to provide a new and improved diving tool kit which provides in the apparatuses and methods of the prior art some of the advantages thereof, while simultaneously overcoming some of the disadvantages normally associated therewith.

Still another object of the present invention is to provide a new and improved diving tool kit wherein the same utilizes a series of tool heads selectively mounted to a forward end of a tool for use in an underwater environment wherein optionally a chemical lighting member is securable within the tool for visual observation thereof.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPITION OF THE DRAWINGS

The invention will be better understood and objects other than those set forth above will become apparent when consideration is given to the following detailed description thereof. Such description makes reference to the annexed drawings wherein:

FIG. 3 is an isometric illustration of the selectively utilized head members for securement of the tool.

FIG. 4 is an isometric illustration of the pouch assembly utilized by the tool.

DESCRIPTION OF THE PREFERRED EMBOIDMENT

Figure 1:
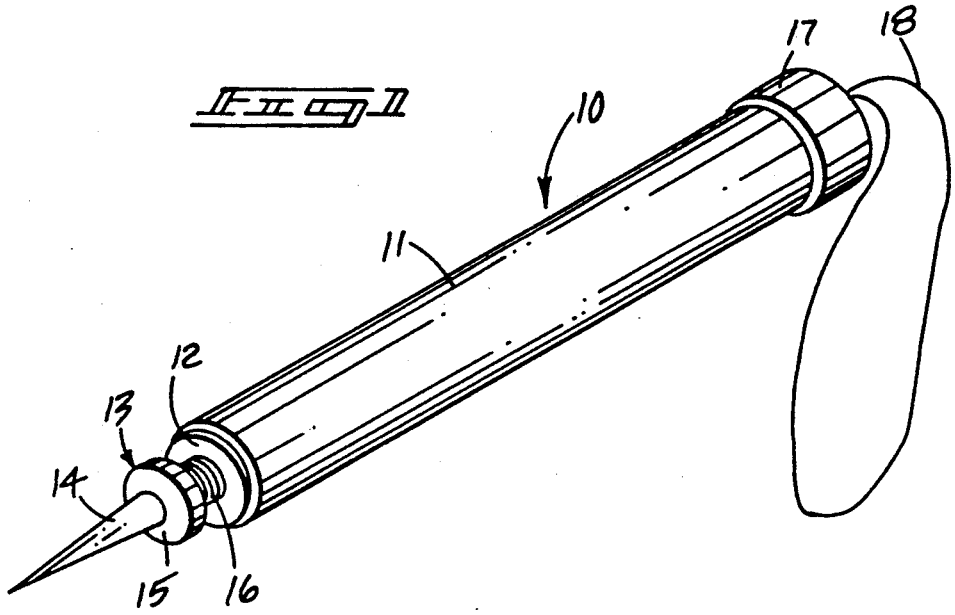
FIG. 1 is an isometri illustration of the istant invention.

With refrence now to the drawings, and in particular to FIGS. 1 to 8 thereof, a new and improved diving tool kit embodying the principles and concepts of the present invention and generally designated by the reference numerals 10 and 10*a* will be described.

More specifically, the diving tool kit 10 essentially comprises a central cylindrical support 11 including a forward end plate 12 sealingly mounted to the forward end of the central cylindrical support 11 formed with a central threaded aperture therethrough coaxially aligned with cylindrical support 11. A first spike tool 13 includes a threaded securement shaft 16 threadedly received within the threaded aperture of the plate 12 with a conically tapered pointed tool member 14 coaxially aligned with the cylindrical support 11 mounted to a coupling mount 15 of a diameter substantially equal to that of the end plate 12 to form an abutment for the pointed tool member 14.

Figure 5:
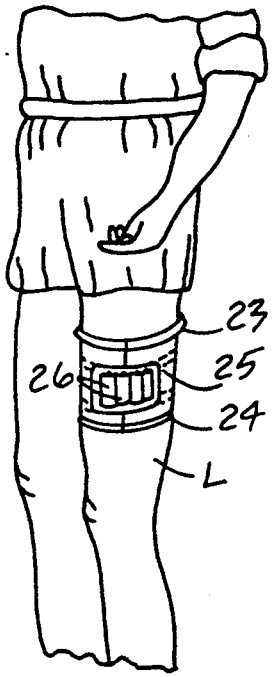
FIG. 5 is an isometric illustration of the pouch assembly in association to an individual.

Reference to FIG. 3 illustrates the tools utilized by the instant invention comprising the spike tool 13, the second chisel tool 13*a*, the third chisel tool 13*b*, the shovel tool 13*c*, and the rake tool 13*d*. The tools each comprise an associated coupling mount 15 through 15*d* with a rearwardly extending threaded securement shaft 16 through 16*d* respectively threadedly receivable within the plate 12. The first chisel tool 13*a* is defined by a chisel of a square cross-sectional configuration, wherein the second chisel tool 13*b* is defined by a second chisel of a rectangular cross-sectional configuration to accommodate various rock crevices and the like to be found in an underwater environment. The shovel tool 13*c* includes a forwardly extending shovel member 21, while the rake tool 13*d* includes a forwardly extending rake member 22. Each of the individual tools are secured either on the associated plate 12 and when not in use, positioned within one of a series of four pockets 26 mounted on a flexible support sheet 25, wherein the support sheet 25 includes a plurality of loop straps comprising an upper loop strap 27 and a lower loop strap 28 mounted to a respective upper encircling strap 23 and a lower encircling strap 24 for securement about an individual's leg "L", as illustrated in FIG. 5, for transport of the tools not in use when an individual is in an underwater environment. To permit securement of the sheet 25 in an alternative manner, the straps 23 and 24 may be mounted rearwardly of the sheet adjacent upper and lower edges of the sheet 25, as illustrated in FIG. 4.

The pockets 26, support sheet 25, upper and lower straps 23 and 24, as well as the upper and lower loop straps 27 and 28, are formed of a commercially available polymeric material to accommodate a corrosive underwater environment.

Figure 2:
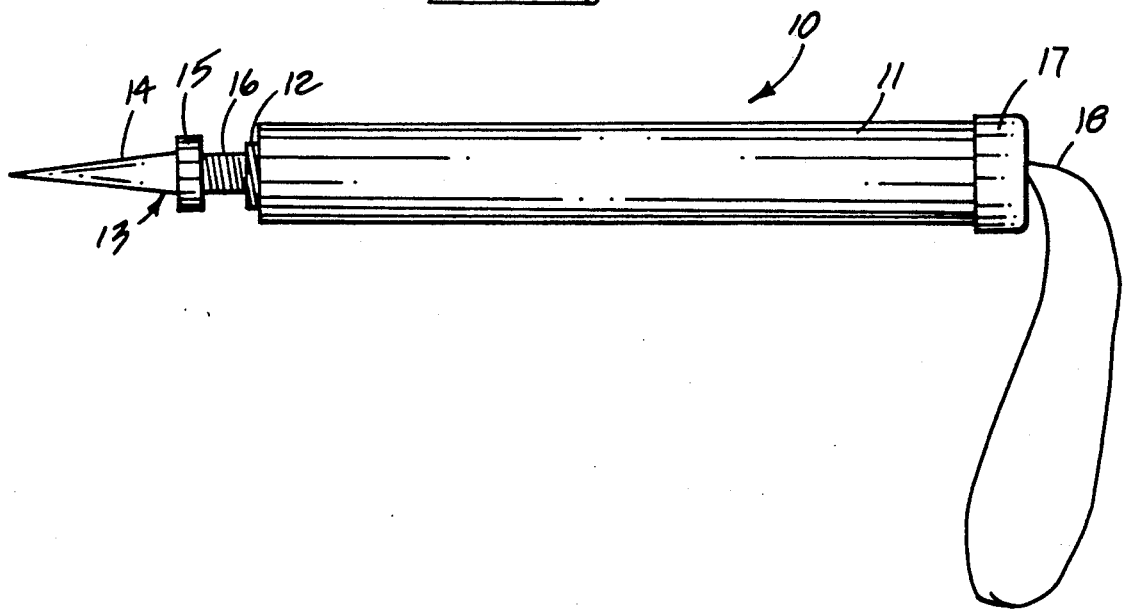
FIG. 2 is an orthographic view taken in elevation of the instant invention.
Figure 6:
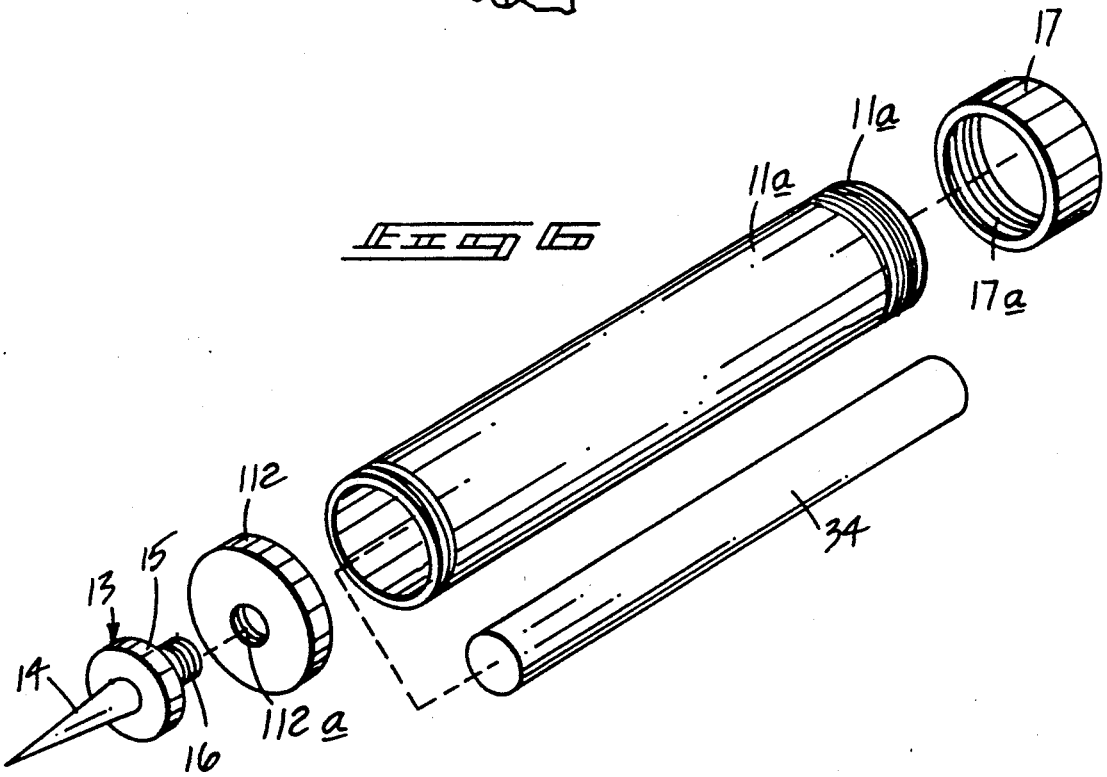
FIG. 6 is an isometric illustration, somewhat exploded, of the various components, their configuration, and relationship.
Figure 7:
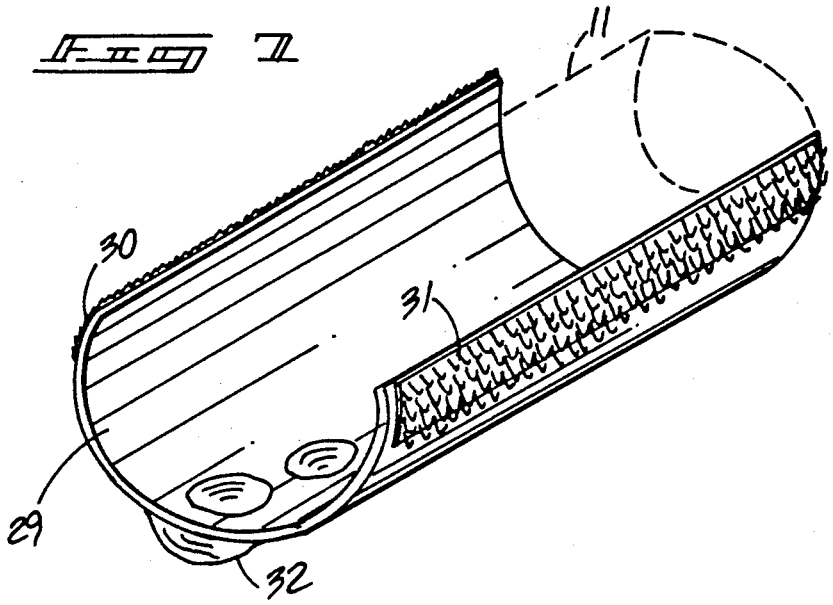
FIG. 7 is an isometric illustration of an optional grip member securable to the tube portion of the tool.
Figure 8B:
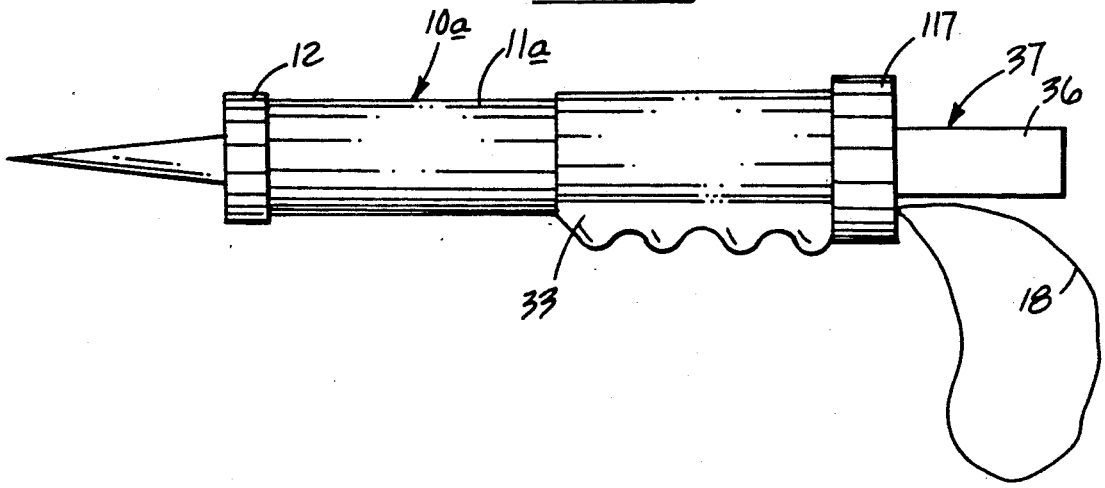
FIG. 8 is an orthographic view taken in elevation of a modified tool kit member in association with a "bang-stick" mounted coaxially thereon.

FIG. 6 illustrates a slightly modified tool wherein the forward plate comprises a threadedly securable cap 112 defining an axially aligned threaded aperture 112*a*. The cap 112, as well as the end cap 17, are threadedly securable relative to the central cylindrical support 11 to receive a removable chemical glow tube 34 therewithin. In this configuration, the central cylindrical support 11*a* is formed of a translucent material to permit the glow of the removable chemical glow tube 34 to be visible in underwater conditions. FIG. 7 is illustrative of a flexible grip member securable to and about the cylindrical support 11 or 11*a* including a flexible polymeric support sheet 29 formed with first and second respective hook and loop fastener strips 30 and 31 coextensively formed on an outer opposed elongate edge of the sheet 29 to enable selective securement of the sheet about the cylindrical support 11 or 11*a*, and is further formed with a series of finger projections 32, wherein the finger projections enable enhanced manual grasping of the grip member and associated support tube. The "bang-stick" or explosive cartridge 36 may also be threadedly mounted to the forward end of the organization such as illustrated in FIG. 2 as a replacement tool in lieu of the spike tool 13 for example.

It should be understood that the components utilized throughout are of a non-corrosive type, such as polymeric or non-corrosive metals, wherein the category may include PVC pipe (polyvinyl chloride), polymerics, magnesium, aluminum, etc.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A diving tool kit for particular use in the underwater environment, comprising, an elongate cylindrical support tube, the tube including a cap member mounted to a rear end of the tube with a forward mount member coaxially secured to a forward end of the tube, and a projecting tool selectively securable to the forward mount member, wherein the projecting tool is coaxially aligned with the tube when secured to the forward mount member, and wherein the forward mount member includes a mount aperture orthogonally formed through the foward mount member and coaxially aligned with the tube, and the projecting tool includes a threaded boss receivable within the mount aperture, the threaded boss including a coupling mounting extending exteriorly of the threaded boss and defined by a predetermined diameter equal to a predetermined diameter defined by the forward mount member, and the projecting tool including a tool means for selective securement to the mount and wherein the tool means includes one of a series of selectively securable tool means in association with a respective coupling member and threaded boss, wherein the tool means comprises a first tool head comprising a conically tapered spike, and a second tool means comprising a first chisel of a square cross-sectional configuration, and a third tool means comprising a second chisel defined by a rectangular cross-sectional configuration, and a fourth tool means comprising a shovel member mounted to an associated coupling member, and fifth tool means comprising a rake, and wherein the kit further includes a pouch member, the pouch member includes a flexible sheet including a series of pockets mounted onto the sheet, and an upper and lower strap with an upper and lower loop mounted to each respective upper and lower strap, the upper and lower loop secured about a respective upper strap and lower strap, the upper strap and lower strap are of an encircling configuration for securement about an individual's leg, and the sheet, the pockets, the upper and lower straps, and the upper and lower encircling straps are each formed of a polymeric material, and wherein the forward mount member includes a second cap member including internal threads securable to external threads formed about a forward end of the tube member, and a selectively positionable removable chemical glow tube positionable within the tube upon removal of the forward mount member, and the tube defined by a translucent meterial.

2. A diving tool kit as set forth in claim 1 further including a grip member, the grip member mounted about the tube member.

3. A diving tool kit as set forth in claim 2 wherien the grip member comprises a flexible sheet member including a series of aligned projections directed exteriorly of the sheet member with first and second respective hook and loop fastener strips integrally formed to opposed exterior end edges of the sheet member, the first hook and loop fastener strips are coextensive with the end edges for securement to one another about the tube.

4. A diving tool kit as set forth in claim 2 wherein the grip member is integrally molded to the tube and includes a series of projections for enhanced gripping of the tube.

5. A diving tool kit as set forth in claim 4 including the support shaft including a cartridge support head wherein an explosive cartridge is selectively securable in the head to effect detonation of an enclosed cartridge upon impacting with an underwater predator.

* * * * *